US007766444B2

(12) United States Patent
Lawrence et al.

(10) Patent No.: US 7,766,444 B2
(45) Date of Patent: Aug. 3, 2010

(54) METHOD FOR CONTROLLING MEDIA FEED IN AN IMAGING APPARATUS

(75) Inventors: Michael William Lawrence, Lexington, KY (US); Michael Anthony Marra, III, Lexington, KY (US); Barry Baxter Stout, Lexington, KY (US); Jay William Vessels, Lexington, KY (US); John Thomas Writt, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 12/338,606

(22) Filed: Dec. 18, 2008

(65) Prior Publication Data

US 2009/0096829 A1 Apr. 16, 2009

Related U.S. Application Data

(62) Division of application No. 11/041,542, filed on Jan. 24, 2005, now Pat. No. 7,559,711.

(51) Int. Cl.
*B41J 29/38* (2006.01)

(52) U.S. Cl. ..... 347/16; 347/101; 347/104

(58) Field of Classification Search ..... 347/16
See application file for complete search history.

(56) References Cited

U.S. PATENT DOCUMENTS 6,809,489 B1 * 10/2004 Yoshida et al. ..... 318/560
2004/0179885 A1 * 9/2004 Adkins et al. ..... 400/636.1

* cited by examiner

*Primary Examiner*—Matthew Luu
*Assistant Examiner*—Brian J Goldberg
(74) *Attorney, Agent, or Firm*—John Victor Pezdek; Justin M. Tromp

(57) ABSTRACT

A method for controlling the media feed of a print media sheet in an imaging apparatus having a media feed roller includes selecting between using absolute positioning of the media feed roller and relative positioning of the media feed roller for various media feed roller moves.

25 Claims, 5 Drawing Sheets

METHOD FOR CONTROLLING MEDIA FEED IN AN IMAGING APPARATUS

CROSS REFERENCE TO RELATED APPLICATION

Pursuant to 37 C.F.R. §1.78, this application is a divisional and claims the benefit of the earlier filing date of application Ser. No. 11/041,542 filed Jan. 24, 2005 now U.S. Pat. No. 7,559,711, entitled "Method for Controlling Media Feed in an Imaging Apparatus."

BACKGROUND OF THE INVENTION

1. Field of the Invention

The present invention relates to an imaging apparatus, and, more particularly, to a method for controlling media feed in an imaging apparatus.

2. Description of the Related Art

An imaging apparatus, such as for example an ink jet printer, may include one or more media transport rolls that convey a sheet of print media to a particular location. In order for an image to be accurately reproduced on the sheet of print media, the imaging apparatus may attempt to provide precise registration between the image and the surface of the sheet of print media. For example, in one printing system, a rotary encoder is configured to generate an encoder signal indicating a detected position of a rotating element, e.g., media transport roller.

Precise registration of the sheet of print media prevents the appearance of defects (e.g., a band between two printed areas that is not present in the original image) caused by slight misalignment of the marking device, e.g., printhead, with respect to the corresponding area of the image receiving surface of the sheet of print media at the time of forming the reproduced image. Typically, there is a tradeoff between the precision at which a sheet of print media can be positioned relative to a desired location and the throughput, i.e., printing speed, of the imaging apparatus. For example, as the precision in the sheet placement improves, the throughput of the imaging apparatus may be reduced.

SUMMARY OF THE INVENTION

The present invention provides a method for controlling media feed in an imaging apparatus using adaptive absolute/relative media feed roller positioning.

The invention, in one form thereof, is directed to a method for controlling the media feed of a print media sheet in an imaging apparatus having a media feed roller, including selecting between using absolute positioning of the media feed roller and relative positioning of the media feed roller for various media feed roller moves.

The invention, in another form thereof, is directed to an imaging apparatus, including a printhead carrier for carrying at least one printhead along a bi-directional scan path. A feed roller unit includes a media feed roller and a drive unit drivably coupled to the media feed roller. The media feed roller is configured to transport a print media sheet in a sheet feed direction substantially perpendicular to the bi-directional scan path. An encoder unit has an encoder electronics module and an encoder wheel connected to the media feed roller for simultaneous rotation therewith. The encoder electronics module is configured to read the encoder wheel. A controller is communicatively coupled to the drive unit and the encoder electronics module. The controller executes program instructions for selecting between using absolute positioning of the media feed roller and relative positioning of the media feed roller for various media feed roller moves.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate embodiments of the invention and such exemplifications arc not to be construed as limiting the scope of the invention in any manner.

DETAILED DESCRIPTION OF THE INVENTION

Figure 1:
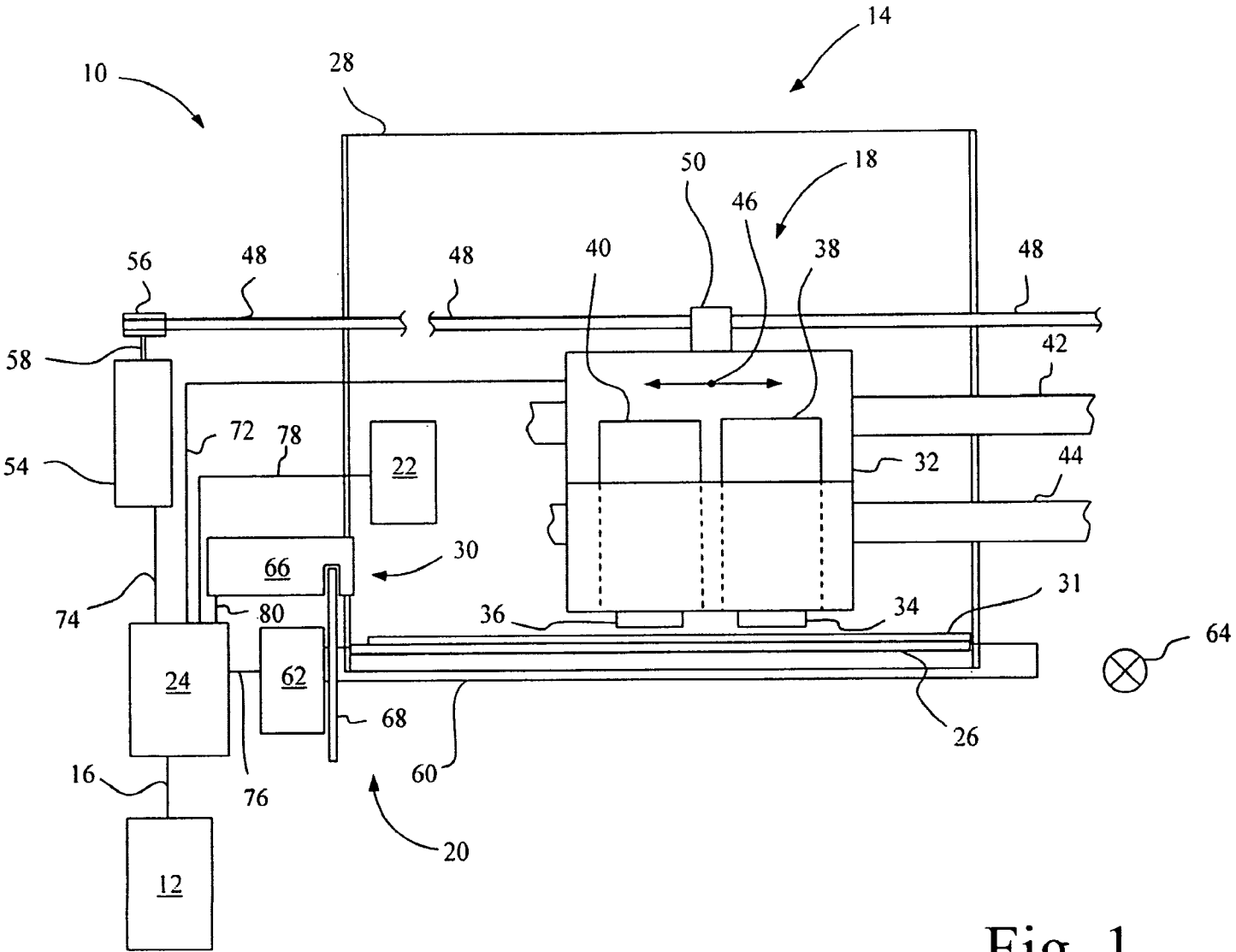
FIG. 1 is a diagrammatic representation of an imaging system embodying the present invention.

Referring now to the drawings, and particularly to FIG. 1, there is shown an imaging system 10 embodying the present invention.

Imaging system 10 includes a host 12 and an imaging apparatus, in the form of an ink jet printer 14 as shown. Ink jet printer 14 may be a conventional inkjet printer, or may form the print engine for a multi-function apparatus, such as for example, a standalone unit that has faxing and copying capability, in addition to printing. Host 12, which may be optional, may be communicatively coupled to ink jet printer 14 via a communications link 16.

As used herein, the term "communications link" generally refers to structure that facilitates electronic communication between two components, and may operate using wired or wireless technology. Accordingly, communications link 16 may be, for example, a direct electrical wired connection, a direct wireless connection (e.g., infrared or r.f.), or a network connection (wired or wireless). inkjet printer 14 includes a printhead carrier system 18, a feed roller unit 20, a sheet picking unit 22, a controller 24, a mid-frame 26, a media source 28, and an encoder unit 30.

In embodiments including host 12, host 12 may be, for example, a personal computer including a display device, an input device (e.g., keyboard), a processor, input/output (I/O) interfaces, memory, such as RAM, ROM, NVRAM, and a mass data storage device, such as a hard drive, CD-ROM and/or DVD units. During a printing operation, host 12 includes in its memory a software program including program instructions that function as a printer driver for ink jet printer 14. The printer driver is in communication with controller 24 of ink jet printer 14 via communications link 16. The printer driver, for example, includes a halftoning unit and a data formatter that places print data and print commands in a format that can be recognized by ink jet printer 14. In a network environment, communications between host 12 and ink jet printer 14 may be facilitated via a standard communication protocol, such as the Network Printer Alliance Protocol (NPAP).

Media source 28 is configured to receive a plurality of print media sheets from which an individual print media sheet 31 is picked by sheet picking unit 22 and transported to feed roller unit 20, which in turn further transports print media sheet 31 during a printing operation over mid-frame 26, which provides support for the print media sheet 31. Print media sheet 31 may be, for example, plain paper, coated paper, photo paper or transparency media.

Printhead carrier system 18 includes a printhead carrier 32 for mounting and carrying a color printhead 34 and/or a monochrome printhead 36. A color ink reservoir 38 is provided in fluid communication with color printhead 34, and a monochrome ink reservoir 40 is provided in fluid communication with monochrome printhead 36. Those skilled in the art will recognize that color printhead 34 and color ink reservoir 38 may be formed as individual discrete units, or may be combined as an integral unitary printhead cartridge. Likewise, monochrome printhead 36 and monochrome ink reservoir 40 may be formed as individual discrete units, or may be combined as an integral unitary printhead cartridge.

Printhead carrier 32 is guided by a pair of guide members 42, 44, such as for example, guide rods, which generally define a bi-directional scanning path 46 for printhead carrier 32. Printhead carrier 32 is connected to a carrier transport belt 48 via a carrier drive attachment device 50. Carrier transport belt 48 is driven by a carrier motor 54 via a carrier pulley 56. Carrier motor 54 has a rotating carrier motor shaft 58 that is attached to carrier pulley 56. At the directive of controller 24, printhead carrier 32 is transported in a reciprocating manner along guide members 42, 44. Carrier motor 54 can be, for example, a direct current (DC) motor or a stepper motor.

Feed roller unit 20 includes a media feed roller 60, and a drive unit 62. Media feed roller 60 is driven by drive unit 62, and pinch rollers (not shown) apply a biasing force to hold the print media sheet 31 in contact with respective driven media feed roller 60. Drive unit 62 includes a drive source, such as for example a direct current (DC) motor, and an associated drive mechanism, such as a gear train or belt/pulley arrangement. Feed roller unit 20 feeds the print media sheet 31 in a sheet feed direction 64, designated in FIG. 1 as an X in a circle to indicate that the sheet feed direction is out of the plane of FIG. 1 toward the reader. The sheet feed direction 64 is commonly referred to as the vertical direction, which is perpendicular to the horizontal bi-directional scanning path 46. Thus, with respect to print media sheet 31, carrier reciprocation occurs in a horizontal direction and media advance occurs in a vertical direction, and the carrier reciprocation is generally perpendicular to the media advance.

Encoder unit 30 includes an encoder electronics module 66 and an encoder wheel 68. Encoder wheel 68 is connected to media feed roller 60 for simultaneous rotation therewith. Encoder electronics module 66 includes, for example, a light element, such as an LED, and two photo sensors, such as photo diodes, defining A and B output channels of encoder unit 30. The A and B output channels provide both positional and rotational direction feedback with respect to movement of media feed roller 60. Encoder electronics module 66 may further include, for example, amplification and offset circuitry, as well as the feedback circuitry. Such amplification, offset, and/or feedback circuitry may be located apart from encoder electronics module 66, such as for example, on a circuit card of ink jet printer 14.

In the embodiment shown, encoder wheel 68 is in the form of a rotary disk including a windowed mask, which is positioned between the light element and photo sensors, which when rotated results in output signals to be present on the A and B channels of encoder unit 30. Those skilled in the art will recognize that other configurations of encoder unit 30 are possible, such as for example, wherein encoder wheel 68 is replaced by a wheel having reflective indicia rather than a windowed mask.

Controller 24 is electrically connected and communicatively coupled to printheads 34, 36 via a communications link 72, such as for example a printhead interface cable. Controller 24 is electrically connected and communicatively coupled to carrier motor 54 via a communications link 74, such as for example an interface cable. Controller 24 is electrically connected and communicatively coupled to drive unit 62 via a communications link 76, such as for example an interface cable. Controller 24 is electrically connected and communicatively coupled to sheet picking unit 22 via a communications link 78, such as for example an interface cable. Controller 24 is electrically connected and communicatively coupled to encoder unit 30 via a communications link 80, such as for example an interface cable.

Controller 24 may be formed as an application specific integrated circuit (ASIC), and includes processing capability, which may be in the form of a microprocessor having an associated random access memory (RAM) and read only memory (ROM). Controller 24 executes program instructions to effect the printing of an image on the print media sheet 31, such as for example, by selecting the index feed distance of print media sheet 31 as conveyed by media feed roller 60, controlling the reciprocation of printhead carrier 32, and controlling the operations of printheads 34, 36.

In addition, controller 24 executes instructions to select the type of media feed roller positioning that will be used on a particular print job in accordance with the present invention. For example, as more fully described below, controller 24 in conjunction with encoder unit 30 controls the position of media feed roller 60 using adaptive absolute/relative positioning, wherein a selection between absolute positioning and relative positioning is made, and wherein the selection may be made intra page (within a single page) or inter page (between consecutive pages).

Figure 2:
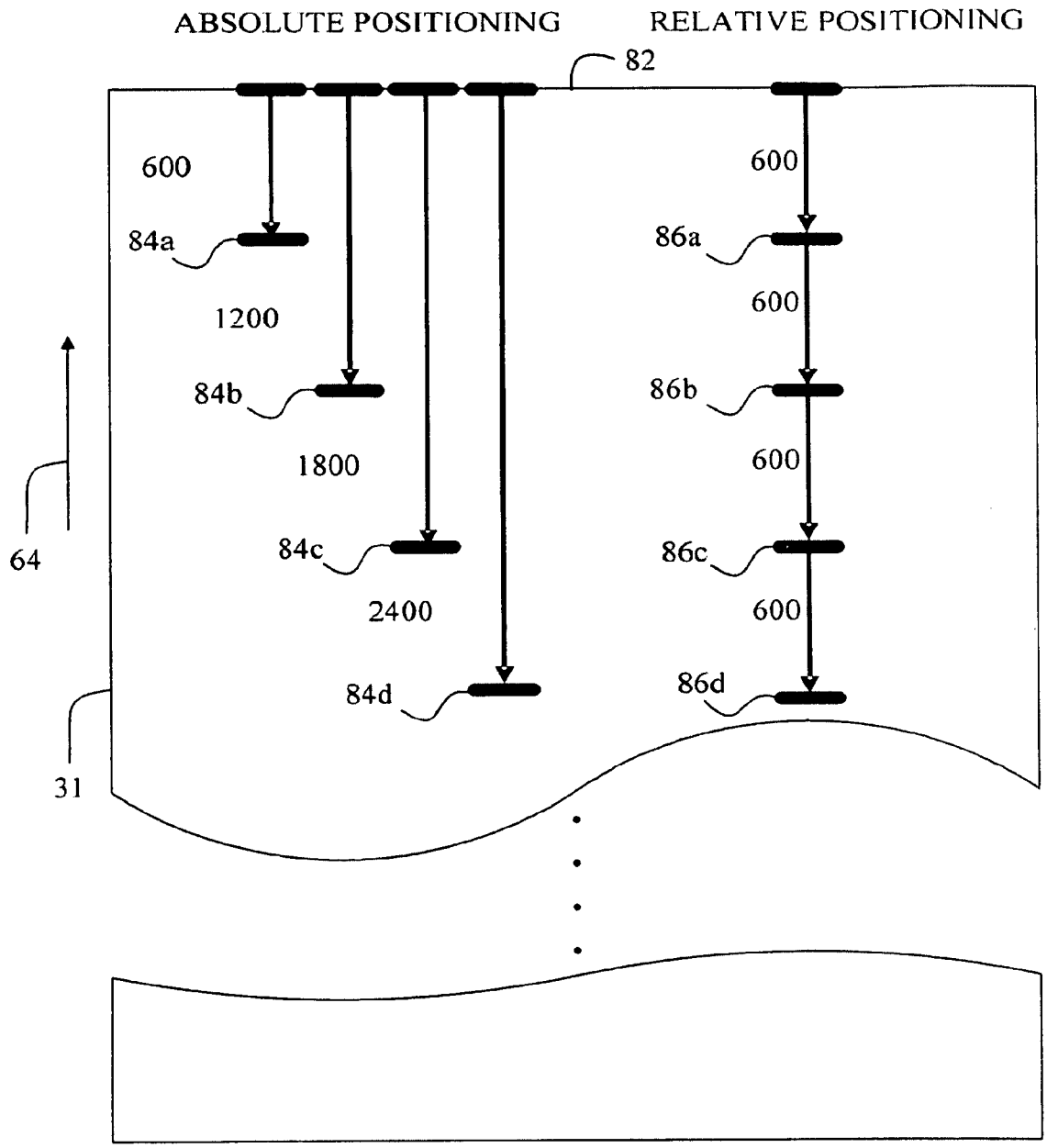
FIG. 2 illustrates and contrasts absolute positioning and relative positioning of the media feed roller of FIG. 1 in relation to the positioning of a print media sheet.

Referring to FIG. 2, as used herein, the term absolute positioning will refer to the positioning of media feed roller 60, or in turn to the positioning of the sheet of print media, e.g., print media sheet 31, at an absolute position for printing using absolute coordinates referenced from a predetermined reference position, such as for example, the top of the page position 82 of print media sheet 31, e.g., a target position that is based on a distance referenced from the top of the page position 82 of print media sheet 31. As shown in FIG. 2, for example, with absolute positioning, each 600 units vertical move in direction 64 results in a target position 84*a* (600 units), 84*b* (1200 units), 84*c* (1800 units), 84*d* (2400 units) being determined with reference to the top of the page position 82, having a coordinate of 0 units. The units may be, for example, a multiple of a predetermined distance, such as for example, 1/1200ths of an inch.

In contrast, as used herein, relative positioning will refer to the positioning of media feed roller 60, or in turn to the positioning of the sheet of print media, e.g., print media sheet 31, at a relative position for printing at some distance past the present printing position down the page of print media sheet 31, i.e., the new target position is based on a distance referenced from tile present printing position of print media sheet 31. As shown in FIG. 2, for example, with relative positioning, while target position 86*a* is determined from the top of the page position 82 based, for example, on a 600 units vertical move in direction 64, each subsequent 600 units vertical move to target positions 86*b*, 86*c*, and 86*d* is with reference to the previous target position, rather than the top of the page position 82.

In general, absolute positioning has some advantages over relative positioning. For example, absolute positioning typically provides better edge to edge printing, since the accumulation of relative positioning errors can cause poor registration at the end of the page. However, there are certain cases where relative positioning or the resetting of encoder unit 30 can enhance the speed of positional moves while at the same time help with image quality.

Resetting encoder unit 30 for each move of media feed roller 60 is equivalent to relative positioning. For example, when encoder unit 30 is reset the next move (M1) uses relative positioning. In other words, resetting encoder unit 30 makes the present position the new reference position, so absolute positioning with respect to the top of the page is lost. However, a subsequent move (M2) may use absolute positioning with respect to the new reference position, or may use relative positioning if encoder unit 30 is again reset at the end of the next move (M1).

As another example of performing relative positioning, if the index move of media feed roller 60 was supposed to stop the movement of print media sheet 31 when print media sheet 31 had moved 5 inches down the page, but it stopped at 5.1 inches down the page, then the present position is changed from 5.1 inches to 5 inches, so controller 24 still operates for the next move as if it were performing absolute positioning, but with respect to the new reference position of 5 inches, which in effect is performing a relative move.

Situations exist where it may be advantageous to switch modes from absolute positioning to relative positioning, or vice-versa, such as for example, When trying to optimize throughput and/or print quality.

The present invention provides selective switching between absolute positioning and relative positioning based upon, for example, the printing mode, the move type, and/or print media type, to obtain a balance between print quality and throughput (printing speed). In addition, selective switching between absolute and relative positioning may be based on whether text is being printed (relative positioning) or an image is being printed (absolute positioning). As used herein, printing mode refers to, for example, a selection of print quality by defining the number of printing passes (e.g., single pass, two-pass, four-pass, etc.) of a printhead, such as printhead 34, used in completing the printing of a horizontal line of dots, referred to herein as a print line, on the printed page, and correspond to such familiar modes as draft printing, normal printing, photo printing, etc. A selection between absolute positioning and relative positioning based, at least in part, on print media type may be made, for example, using empirical data with respect to print quality for a particular printing mode.

In accordance with the operation of ink jet printer 14, there are two move types that are used in printing: print index moves, and white space skip moves. The print index move refers to the incremental movement of the print media sheet during printing of a particular region by an appropriate distance, such as to aid in shingling. For instance, in the 2-pass mode with a one-half inch high print head, media feed roller 60 will move print media sheet 31 one-fourth of an inch between printing passes of printhead 34 and/or printhead 36 to position print media sheet 31 in the proper location to allow the interleaving of the printed patterns laid down on each of the respective printing passes. The white space skip moves include all non-print index moves covering the white space on the page of print media sheet 31, such as for example, the top and bottom margins, and the region between printed areas on the page.

In accordance with the present invention, as between absolute positioning and relative positioning, absolute positioning is preferred for accommodating high quality print moves that have several printing passes. However, relative positioning is preferred for high speed single-pass modes, e.g., draft mode, to reduce the appearance of print defects.

Figure 3A:
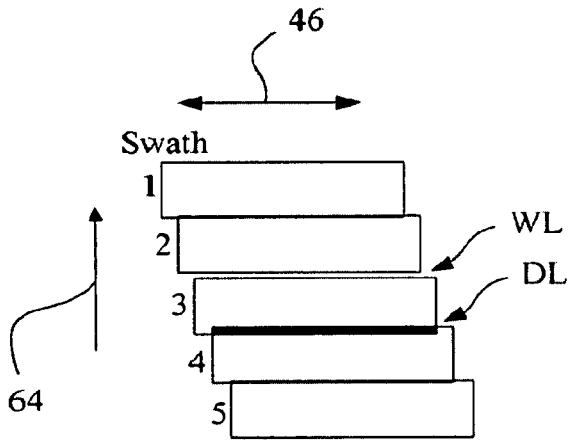
FIGS. 3A-3D illustrate four examples for print index move errors with respect to the type of positioning used in a single pass mode.
Figure 3B:
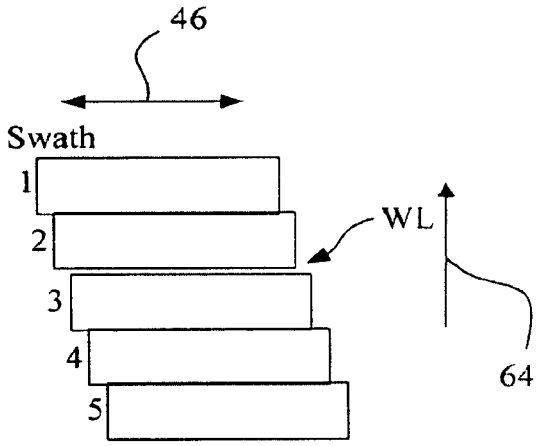
Figure 3C:
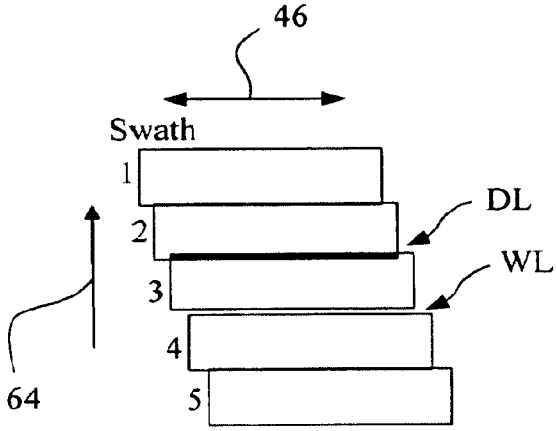
Figure 3D:
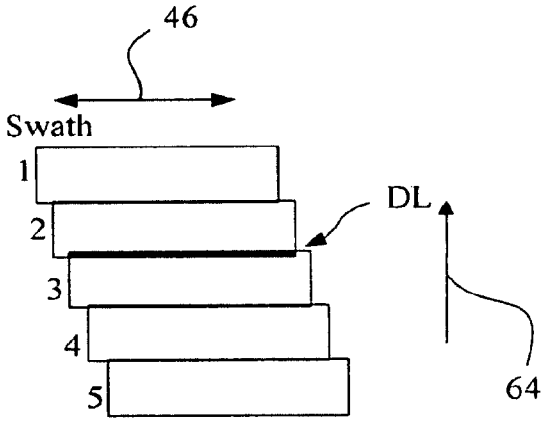

FIGS. 3A-3D illustrate four examples for print index move errors with respect to the move type, i.e., the type of positioning, used in a single pass mode for print swaths 1-5. As used herein, a swath refers to the coverage area of a printhead, such as color printhead 34, during a single pass of the printhead in bi-directional scanning path 46. FIG. 3A illustrates print media sheet overfeed with absolute positioning. FIG. 3B illustrates print media sheet overfeed with relative positioning. FIG. 3C illustrates print media sheet underfeed with absolute positioning. FIG. 3D illustrates print media sheet underfeed with relative positioning.

For the print media sheet overfeed with absolute positioning illustrated in FIG. 3A, absolute positioning causes two print defects, a white line WL and a dark line DL. However, as illustrated by the print media sheet overfeed with relative positioning of FIG. 3B, relative positioning has only one print defect, i.e., a white line WL.

There is a similar case when there is an underfeed index error, as illustrated in FIGS. 3C and 3D. The absolute positioning illustrated in FIG. 3C results in two print defects, a dark line DL and a white line WL. However, the relative positioning of FIG. 3D results in only one print defect, a dark line DL.

Thus, as shown in FIGS. 3A-3D, relative positioning, wherein media feed roller 60 is moved using relative positioning, reduces visible print defects for single-pass modes, over that when media feed roller 60 is moved using absolute positioning.

Figure 4A:
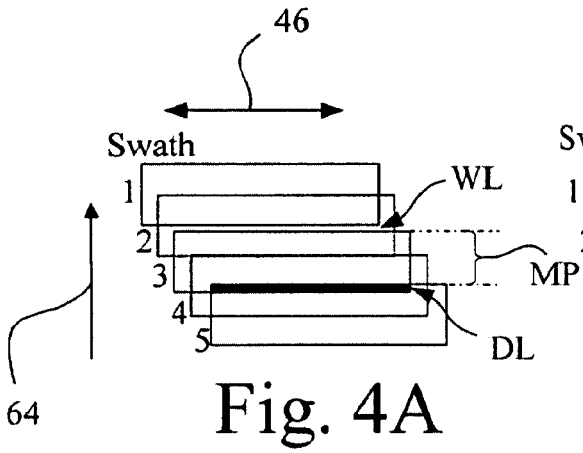
FIGS. 4A-4D illustrate four examples for print index move errors with respect to the type of positioning used in a two-pass mode.
Figure 4B:
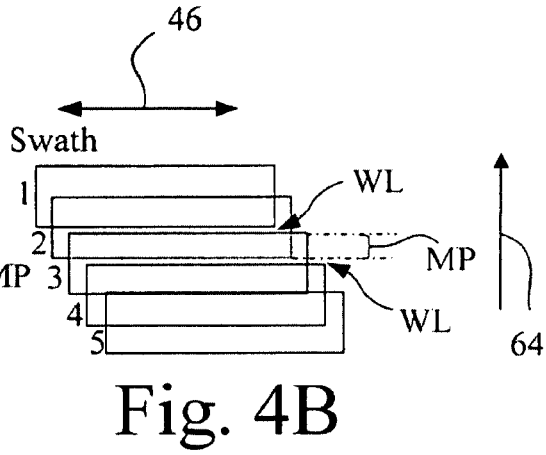
Figure 4C:
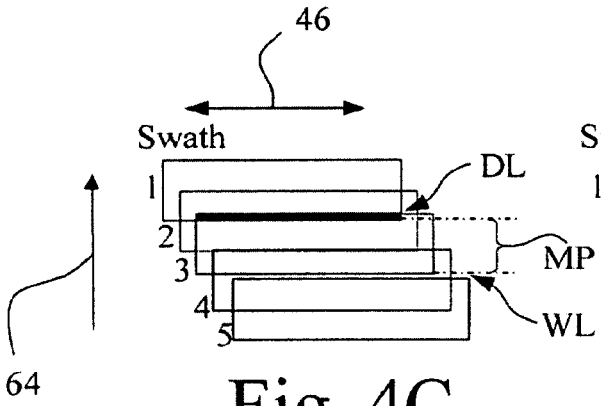
Figure 4D:
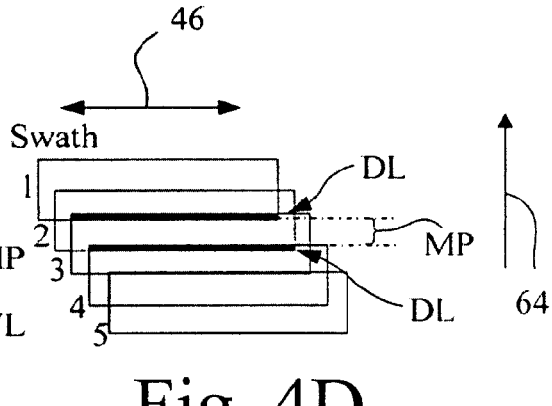

FIGS. 4A-4D illustrate four examples for print index move errors with respect to the move type used in a two-pass mode. FIG. 4A illustrates print media sheet overfeed with absolute positioning. FIG. 4B illustrates print media sheet overfeed with relative positioning. FIG. 4C illustrates print media sheet underfeed with absolute positioning. FIG. 4D illustrates print media sheet underfeed with relative positioning.

The two-pass mode illustrated in FIGS. 4A-4D may be thought of as a boundary condition, and it is not as obvious if absolute positioning or relative positioning would be optimal. The print swath of print swaths 1-5 associated with the move error of interest is highlighted in gray for ease of viewing. All four of the conditions shown in FIGS. 4A-4D produce three errors, two lines (white WL and/or dark DL) and an area of misaligned print overlap MP (assuming it is off by an odd pel spacing).

The overfeed for swath 3 with absolute positioning illustrated in FIG. 4A produces a white line WL, a dark line DL, and an area of misaligned print MP that is approximately the height of the printhead, e.g., printhead 34. The overfeed of swath 3 with relative positioning illustrated in FIG. 3B produces two white lines WL and an area of misaligned print MP that is approximately half the height of the printhead. White lines WL are generally the most noticeable print defect in low-pass number printing, so the relative positioning illustrated in FIG. 4B is not necessarily preferred to absolute positioning illustrated in FIG. 4A.

The underfeed for swath 3 with absolute positioning illustrated in FIG. 4C produces a dark line DL, a white line WL, and an area of misaligned print MP that is approximately the height of the printhead. Underfeed for swath 3 with relative positioning illustrated in FIG. 4D produces two dark lines DL and an area of misaligned print MP that is approximately half the height of the printhead. In this case, the relative positioning illustrated in FIG. 4D is preferred to the absolute positioning illustrated in FIG. 4C, since a dark line DL essentially replaces a white line and the misaligned print MP area is cut in half.

Figure 5:
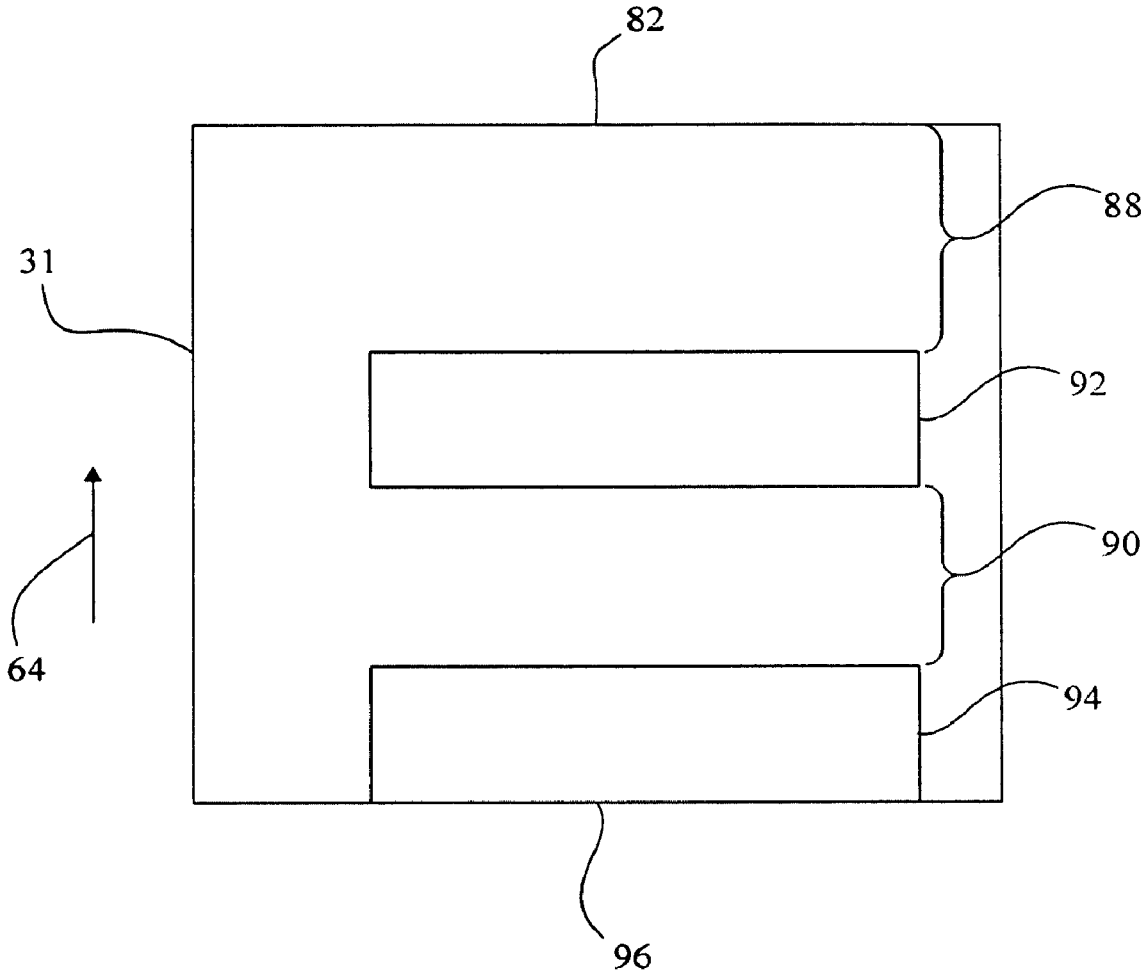
FIG. 5 illustrates two white space skip regions in relation to two printed regions.

FIG. 5 illustrates two white space skip regions, a first white space skip region 88 associated with a first white space skip move and a second white space skip region 90 associated with a second white space skip move. Print media sheet 31 is positioned after the first white space skip move associated with white space skip region 88 from the top of page position 82 to begin printing in a first print region 92. Thereafter, at the beginning of printing of first print region 92, encoder unit 30 may be reset. At the end of printing of first print region 92, the second white space skip move associated with second white space skip region 90 is performed from the end position of first print region 92 to the start position of the second print region 94. At the end of the second white skip move encoder unit 30 may be reset. Resetting encoder unit 30 is particularly useful when considering such white space skips, since it usually makes little difference in image quality for the white space skip move to have relatively large media feed errors compared to a print index move. This is especially apparent in a draft mode where the margins are more forgiving than, for example, during edge-to-edge printing in one of the higher quality modes requiring more than two passes.

The white space skip regions 88, 90 may be formed by respective white space skip moves involving a relatively fast indexing of media feed roller 60, since, for example, the accuracy of the positioning of the beginning of first print region 92 is of lower importance since it is proceeded by white space skip region 88. For example, media feed roller 60 may be accelerated at a first acceleration rate for print index moves, and media feed roller 60 may be accelerated at a second acceleration rate greater than the first acceleration rate for white space skip moves. Additionally media feed roller 60 may be decelerated at a first deceleration rate for print index moves, and media feed roller 60 may be decelerated at a second deceleration rate greater than, i.e., a faster deceleration than, the first deceleration rate for white space skip moves. Accordingly, the white space skip move may be made with faster than normal acceleration and deceleration of media feed roller 60 to sacrifice accuracy for speed. Further, media feed roller 60 may be rapidly braked when media feed roller 60 gets close to its final index position by shutting off power to the motor of drive unit 62 or reversing the current to the motor of drive unit 62 at a certain speed or position.

Printing of print regions 92 and 94 shown in FIG. 5 may occur, for example, using the adaptive positioning criteria described above with respect to FIGS. 3A-4D. The adaptive positioning approach of the present invention selects between absolute positioning and relative positioning depending upon certain conditions. For example, media feeds associated with high quality printing having multiple passes, e.g., more than two printhead passes, may be made by selecting absolute positioning. Media feeds associated with high printing speeds that have a single printhead pass (single pass mode) may be made by selecting relative positioning. Media feeds associated with the two-pass mode is conditional based upon the type of print index error, wherein absolute positioning, i.e., absolute positioning of media feed roller 60, is selected except when there is an underfeed. In the case of an underfeed, the absolute position reference is updated so that subsequent moves are made relative to the short move.

Those skilled in the art will recognize that variations are possible for adaptive positioning from the examples given above, such as for example, having the conditional two-pass mode make its selection decision based on odd or even pel misalignment, or the magnitude of misalignment, or by having two-pass modes all relative positioning or all absolute positioning to reduce controller complexity.

For reactive print index moves, encoder unit 30 may be reset, or a relative position index move may be made, if the previous print index move was measured to be out of spec. For example, this would minimize banding in a one pass mode if there is an overfeed error by producing one white line WL rather than a white line WL followed by a dark line DL (see, for example, FIGS. 3A and 3B).

For reactive white space skips, the white space skip move may be designed to always fall short of the target position. Overall, this guarantees that media feed roller 60 will underfeed print media sheet 31, so that printing on the bottom of the page 96 of print media sheet 31 does not exceed the desired overspray amount for edge-to-edge printing (FIG. 5), or exceed the margin amount for normal printing.

Further, detected print index errors associated with relative positioning may be accumulated in memory associated with controller 24, and then the length of a white space skip move may be changed to compensate for the accumulated print index errors. Still further, under certain conditions it may be desirable to revert back to absolute positioning from relative positioning with respect to the most recent move, such as in the case that it is determined that continuing printing using relative positioning will result in undesired printing off of the bottom of the page of print media sheet 31. In addition, if it is determined that the first white space skip move overfed, then the length of the next white space skip move may be made to intentionally underfeed.

As a further alternative, a white space skip move may result in media overfeed error or media underfeed error depending on print media type. The media feed error associated with the various different media types may be measured and stored in memory associated with controller 24, and used as an offset to correct white space skip move errors. For example, if a rapid, and less accurate, white space skip move always stops media feed roller 60 conveying card stock 40 microns too far, then the target distance of the next white space skip move may be changed accordingly, e.g., the length of the next white space skip move may be reduced by 40 microns. This may be, for example, a constant offset for all printers after taking data from a large sample, or a self-adjusting parameter.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus, comprising:

a printhead carrier for carrying at least one printhead along a bi-directional scan path;

a feed roller unit including a media feed roller and a drive unit drivably coupled to said media feed roller, said media feed roller being configured to transport a print media sheet in a sheet feed direction substantially perpendicular to said bi-directional scan path;

an encoder unit having an encoder electronics module and an encoder wheel connected to said media feed roller for simultaneous rotation therewith, said encoder electronics module being configured to read said encoder wheel; and a controller communicatively coupled to said drive unit and said encoder electronics module, said controller executing program instructions for selecting between using absolute positioning of said media feed roller and relative positioning of said media feed roller for various media feed roller moves.

2. The imaging apparatus of claim 1, wherein said various media feed roller moves include print index moves.

3. The imaging apparatus of claim 2, wherein said controller selects absolute positioning for said print index moves for a printing mode requiring more than a predetermined number of passes of a printhead to complete printing of a print line.

4. The imaging apparatus of claim 2, wherein said controller selects relative positioning for said print index moves for a printing mode requiring not more than a predetermined number of passes of a printhead to complete printing of a print line.

5. The imaging apparatus of claim 2, wherein whether absolute positioning or relative positioning is selected for said print index moves is conditional based upon a type of print index error.

6. The imaging apparatus of claim 5, wherein said print index error is one of an underfeed and an overfeed.

7. The imaging apparatus of claim 5, wherein said print index error is a pel misalignment for multiple passes of a printhead to complete printing of a print line.

8. The imaging apparatus of claim 5, wherein said controller selects absolute positioning except when said print index error is an underfeed.

9. The imaging apparatus of claim 5, wherein if said print index error is an underfeed, said controller resets an absolute position reference to in effect select relative positioning.

10. The imaging apparatus of claim 5, wherein said various media feed roller moves include at least one white space skip move, and wherein said print index errors associated with said print index moves are accumulated in memory associated with said controller, said controller compensating for the accumulated print index errors during said at least one white space skip move.

11. The imaging apparatus of claim 2, wherein said various media feed roller moves include at least one white space skip move.

12. The imaging apparatus of claim 11, wherein said controller selects relative positioning for said at least one white space skip move.

13. The imaging apparatus of claim 11, wherein said controller controls said media feed roller to accelerate at a first acceleration rate for said print index moves and controls said media feed roller to accelerate at a second acceleration rate greater than said first acceleration rate for said at least one white space skip moves.

14. The imaging apparatus of claim 11, wherein said controller controls said media feed roller to decelerate at a first deceleration rate for said print index moves and controls said media feed roller to decelerate at a second deceleration rate greater than said first deceleration rate for said at least one white space skip moves.

15. The imaging apparatus of claim 11, wherein said controller compensates for one of a media overfeed error and a media underfeed error that occurs during a previous white space skip move during a subsequent white space skip move.

16. The imaging apparatus of claim 15, wherein an amount of compensation is predetermined based on media type.

17. The imaging apparatus of claim 1, wherein said controller performs the selecting based on at least one of a printing mode, a media feed error determination, and a media type.

18. The imaging apparatus of claim 1, wherein said controller performs the selecting between consecutive pages.

19. The imaging apparatus of claim 1, wherein said controller performs the selecting intra page.

20. The imaging apparatus of claim 1, wherein after selecting relative positioning of said media feed roller for various media feed roller moves, said controller reverts back to absolute positioning from relative positioning if said controller determines that continuing printing using relative positioning will result in undesired printing off of a bottom of the page of said print media sheet.

21. An imaging apparatus, comprising:

a printhead carrier for carrying at least one printhead along a bi-directional scan path;

a feed roller unit including a media feed roller and a drive unit drivably coupled to said media feed roller, said media feed roller being configured to transport a print media sheet in a sheet feed direction substantially perpendicular to said bi-directional scan path;

an encoder unit having an encoder electronics module and an encoder wheel connected to said media feed roller for simultaneous rotation therewith, said encoder electronics module being configured to read said encoder wheel; and a controller communicatively coupled to said drive unit and said encoder electronics module, said controller executing program instructions for selecting between using absolute positioning of said media feed roller and relative positioning of said media feed roller for various media feed roller moves including print index moves where conditional upon a type of print index error, one of absolute positioning or relative positioning is selected for said print index moves and where said type of print index error is an underfeed, said controller resets an absolute position reference to in effect select relative positioning.

22. A imaging apparatus, comprising:

a printhead carrier for carrying at least one printhead along a bi-directional scan path;

a feed roller unit including a media feed roller and a drive unit drivably coupled to said media feed roller, said media feed roller being configured to transport a print media sheet in a sheet feed direction substantially perpendicular to said bi-directional scan path;

an encoder unit having an encoder electronics module and an encoder wheel connected to said media feed roller for simultaneous rotation therewith, said encoder electronics module being configured to read said encoder wheel; and a controller communicatively coupled to said drive unit and said encoder electronics module, said controller executing program instructions for selecting between using absolute positioning of said media feed roller and relative positioning of said media feed roller for various media feed roller moves including print index moves and at least one white space skip move, said controller controlling said media feed roller to accelerate at a first acceleration rate for said print index moves and controls said media feed roller to accelerate at a second acceleration rate greater than said first acceleration rate for said at least one white space skip move.

23. A imaging apparatus, comprising:

a printhead carrier for carrying at least one printhead along a bi-directional scan path;

a feed roller unit including a media feed roller and a drive unit drivably coupled to said media feed roller, said media feed roller being configured to transport a print media sheet in a sheet feed direction substantially perpendicular to said bi-directional scan path;

an encoder unit having an encoder electronics module and an encoder wheel connected to said media feed roller for simultaneous rotation therewith, said encoder electronics module being configured to read said encoder wheel; and a controller communicatively coupled to said drive unit and said encoder electronics module, said controller executing program instructions for selecting between using absolute positioning of said media feed roller and relative positioning of said media feed roller for various media feed roller moves including print index moves and at least one white space skip move, said controller controlling said media feed roller to decelerate at a first deceleration rate for said print index moves and controls said media feed roller to decelerate at a second deceleration rate greater than said first deceleration rate for said at least one white space skip move.

24. A imaging apparatus, comprising:

a printhead carrier for carrying at least one printhead along a bi-directional scan path;

a feed roller unit including a media feed roller and a drive unit drivably coupled to said media feed roller, said media feed roller being configured to transport a print media sheet in a sheet feed direction substantially perpendicular to said bi-directional scan path;

an encoder unit having an encoder electronics module and an encoder wheel connected to said media feed roller for simultaneous rotation therewith, said encoder electronics module being configured to read said encoder wheel; and a controller communicatively coupled to said drive unit and said encoder electronics module, said controller executing program instructions for selecting between using absolute positioning of said media feed roller and relative positioning of said media feed roller for various media feed roller moves including print index moves and at least one white space skip move, said controller compensating for one of a media overfeed error and a media underfeed error that occurs during a previous white space skip move during a subsequent white space skip move.

25. The imaging apparatus of claim 24, wherein an amount of compensation is predetermined based on media type.

* * * * *